United States Patent [19]

Kunioka et al.

[11] 4,149,913

[45] Apr. 17, 1979

[54] METHOD OF COOLING OUTER SURFACE OF LARGE DIAMETER METAL PIPE

[75] Inventors: Kazuo Kunioka; Takao Noguchi, both of Yokohama; Hiroaki Sato, Tokyo, all of Japan

[73] Assignee: Nippon Kokan Kabushiki Kaisha, Tokyo, Japan

[21] Appl. No.: 732,642

[22] Filed: Oct. 15, 1976

[30] Foreign Application Priority Data

Oct. 16, 1975 [JP] Japan ..... 50-123849

[51] Int. Cl.[2] ..... C21D 9/08

[52] U.S. Cl. ..... 148/153; 148/157

[58] Field of Search ..... 148/143, 153, 157

[56] References Cited

U.S. PATENT DOCUMENTS

| | | | |
|---|---|---|---|
| 3,507,712 | 4/1970 | Scott | 148/143 |
| 3,675,908 | 7/1972 | Amend | 148/143 |

*Primary Examiner*—R. Dean

*Attorney, Agent, or Firm*—Haseltine, Lake & Waters

[57] ABSTRACT

In rapidly cooling a large diameter metal pipe for quenching purposes, the essential requirements for ensuring uniform cooling of the pipe, namely, the jet velocity and the dip angle and transverse angle of jets of the cooling water directed against the surface of the pipe from a large number of spray nozzles contained in each of a first and second ring header encircling the pipe, and the distance between the circumferential line defined on the pipe by connecting the points of impingement onto the pipe surface of the water jets sprayed in the direction of the second header from the spray nozzles of the first header and the similar circumferential line defined on the pipe by connecting the points of impingement onto the pipe surface of the water jets sprayed in the direction of the first header from the spray nozzles of the rear second header, are specified with numerical values.

3 Claims, 7 Drawing Figures

METHOD OF COOLING OUTER SURFACE OF LARGE DIAMETER METAL PIPE

BACKGROUND OF THE INVENTION

The present invention relates to a method of cooling, particularly during the quenching operation, the outer surface of large diameter metal pipes from 18 inches to 50 inches or more in diameter. More particularly the invention relates to a cooling method for such pipes which is capable of reducing the amount of uneven circumferential cooling of the pipe when the pipe which has been heated to its quenching temperature in a high-frequency induction electric heating unit or the like is rapidly cooled while the pipe is being passed through the rings.

In the known methods of the above type such as shown in FIG. 1 of the drawings, the rapid cooling of a large diameter metal pipe for quenching purposes is accomplished by spraying a coolant, e.g., water from a ring header 1 against the pipe. In this case, the usual practice is to spray water against the pipe surface to be cooled in such a manner that the water jets are directed toward a central axis 3 of the pipe with a certain dip angle and in a direction opposite to a heating unit 4. With these conventional methods, however, the careful consideration of the jet velocity or the dip angle of coolant such as water is for the most part omitted, with the result that not only the sprayed coolant is not necessarily utilized effectively for cooling the pipe, but also there results considerable variations in the circumferential cooling rate of the pipe. As a result, a strain is caused in the cooled pipe thus presenting a serious problem. This strain consists of a thermal strain caused by variations in the cooling rate at different parts of the pipe during the cooling or the thermal strain plus a transformation strain and thus it is essential to uniformly cool the entire pipe from the beginning of the cooling operation to the transformation completion temperature (e.g., from about $Ac_3$ to 400° C. in the case of steel pipes). Where the wall thickness of a pipe to be cooled is large or the travel speed of the pipe is high, the conventional methods usually arrange at least one header 2 of the same construction (as to the spray angle and direction) in the rear of the first stage header 1 as shown in FIG. 1, since the cooling of the pipe from the cooling starting point to the desired cooling complete temperature cannot be effected within a predetermined time with a single cooling header. In the case of the conventional methods, irrespective of the number of the headers used, the sprayed cooling water flows down from the upper portion to the lower portion of a pipe along its wall. Thus, despite the fact that the coolant is uniformly sprayed circumferentially against the pipe, the cooling effect on the lower pipe portion is increased by the above-mentioned reasons, with the result that the upper and lower pipe portions are unevenly cooled and the resulting thermal or transformation strain or both cause the long pipe to bend or become out-of-round.

SUMMARY OF THE INVENTION

With a view to overcoming the foregoing difficulty, it is the object of the present invention to provide an improved method of cooling a large diameter metal pipe wherein the pipe is rapidly cooled uniformly in the circumferential direction, thus eliminating the need for further correcting operations heretofore required to ensure the desired roundness as well as the straigness in the lengthwise direction of the pipe.

According to the present invention, the foregoing and other objects are obtained by properly determining the dip and transverse angles of jets of the cooling water directed against the surface of a heated metal pipe from a large number of spray nozzles contained in each of first and second headers arranged to encircle the outer metal surface to be cooled thus ensuring uniform and rapid cooling of the pipe and also by causing the first and second headers to respectively direct the water jets toward each other and properly determining the jet velocity and the distance between the circumferential lines defined on the pipe surface by connecting the points of impingement onto the pipe surface of the jets from each of the first and second headers so as to provide a swell of the cooling water therebetween and thereby ensure uniform cooling of the cooled pipe.

DESCRIPTION OF THE PREFERRED EMBODIMENTS

The present invention will now be described in greater detail with reference to the illustrated embodiments.

Figure 1:
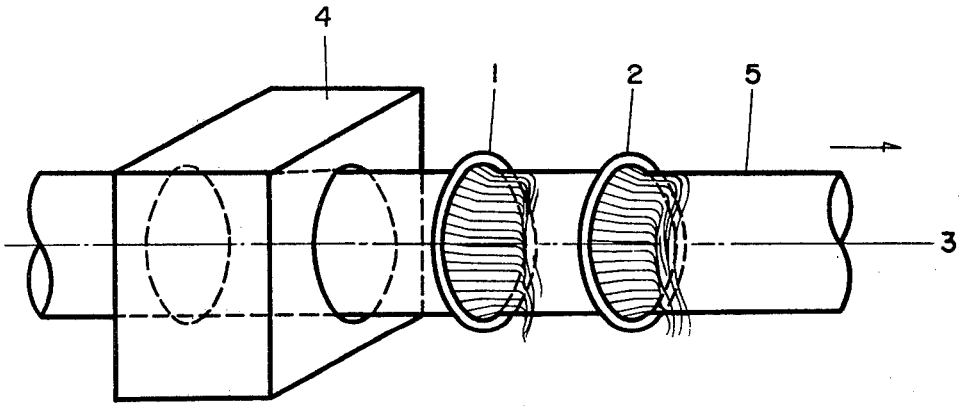
FIG. 1 is a schematic diagram of a quenching apparatus used with a conventional method.
Figure 2:
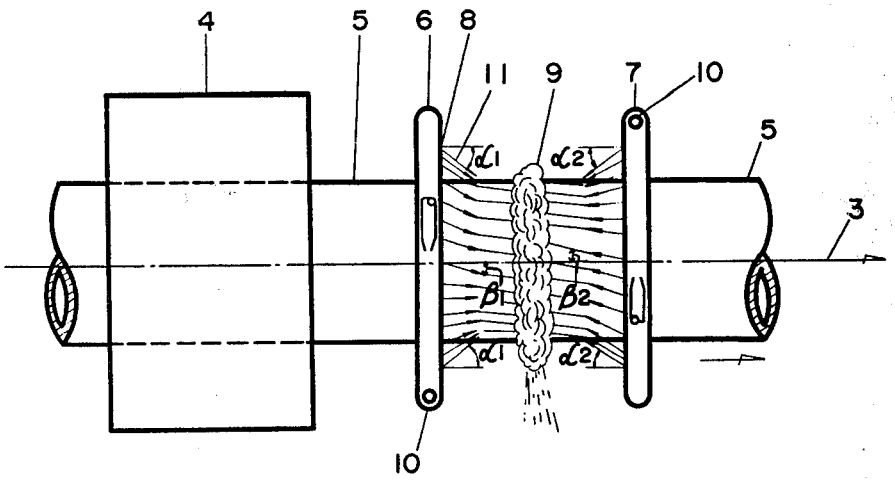
FIG. 2 is a schematic diagram of a preferred apparatus for performing the improved method of the present invention.

Referring first to FIG. 2, there is illustrated in detailed the construction of a preferred apparatus for performing the improved method of this invention. FIG. 2 shows the conditions in which a metal pipe 5 which has been heated by a high frequency induction electric heating unit 4 or the like is being passed in the direction of an arrow and ring-shaped first and second headers 6 and 7 which are arranged to encircle the outer surface of the pipe 5 direct water jets 11 from their spray nozzles 8 to impinge onto the pipe surface in such a manner that the water jets from the two headers flow over the pipe surface in the form of laminar flows which are suitable for cooling the pipe and the laminar flows of the cooling water from the headers 6 and 7 strike against each other thus forming a swell 9 of the cooling water on the pipe surface and thereby ensuring uniform cooling of the metal pipe.

Looked at the cross-section of the pipe taken through the position of the swell 9, the water jets 11 from the spray nozzles 8 of the first header 6 impinge onto the pipe surface in the form of water jets turning counterclockwise or downwardly to incline to the left on the upper pipe portion. The second header 7 is substantially identical in construction with the first header 6 and it is arranged to direct its water jets toward the first header 6. Thus, after impinging onto the pipe surface, the water jets from the two headers flow over the surface of the pipe and strike head on with each other on the pipe surface thus forming the swell 9. Instead of turning in the counterclockwise direction, the water jets may be caused to turn in the clockwise direction.

The method of this invention as performed by the cooling apparatus constructed as described above has the following features.

(a) The water jets 11 from the spray nozzles 8 of the first header 1 are directed against the pipe surface with the following dip angle $\alpha_1$ and transverse angle $\beta_1$ as measured in the manner shown in FIG. 2

Dip angle $\alpha_1$: $15° \leqq \alpha_1 \leqq 45°$

Transverse angle $\beta_1$: $0° < \beta_1 \leqq 65°$ (Preferably $\beta_1 = 25°$ to $65°$)

(b) The distance between the circumferential line defined on the pipe surface by connecting the points of impingement onto the pipe surface of the water jets 11 from the first header 6 which are directed toward the second header 7 and the similar circumferential line defined by the water jets from the second header 7 which are directed toward the first header 6, is in the range of between 50 and 250 mm.

(c) The velocity of the water jets 11 from the spray nozzles 8 in the first and second headers 6 and 7 is in the range of between 0.5 and 7 m/sec.

(d) The laminar flows of the water jets from the headers strike against each other on the pipe surface thus forming the swell 9 of the cooling water at substantially the middle of the above-mentioned distance of 50 to 250 mm.

These numerical limitations are based on the following grounds. As regards the feature (c), if the flow velocity is selected lower than 0.5 m/sec, it is impossible for the jet water from the lower spray nozzles 8 to overcome the gravitational force and reach the lower surface of the pipe, whereas if the velocity is higher than 7 m/sec a great part of the water jets 11 is rebounded at the points of their impingement onto the pipe surface thus making it impossible to ensure full utilization of the cooling capacity of the cooling water used. With the velocity falling within the previously mentioned limits, the knetic energy of jet water comes within the range of control of the surface tension of water with the result that the water jets 11 sprayed from the spray nozzles 8 as well as the water stream after the impingement result in a laminar flow, thus increasing the uniformly cooled surface area and making it possible to utilize the cooling capacity of the cooling water with a far greater efficiency than would be the case with the conventional methods.

As regards the feature (a), the first leader 6 has a decisive effect on the cooling effect during the initial period of cooling which in turn has an important effect on the desired circumferential uniform cooling of the pipe. Thus, it is essential that the dip angle $\alpha_1$ and the transverse angle $\beta_1$ of the water jets from the first header 6 are kept within the proper limits.

Figure 3:
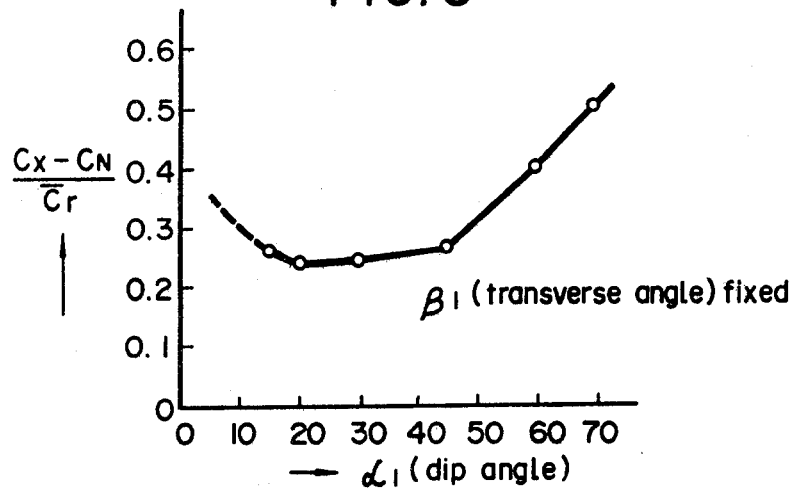
FIG. 3 is a graph showing the relationship between the dip angle and the uniform cooling effect.
Figure 4:
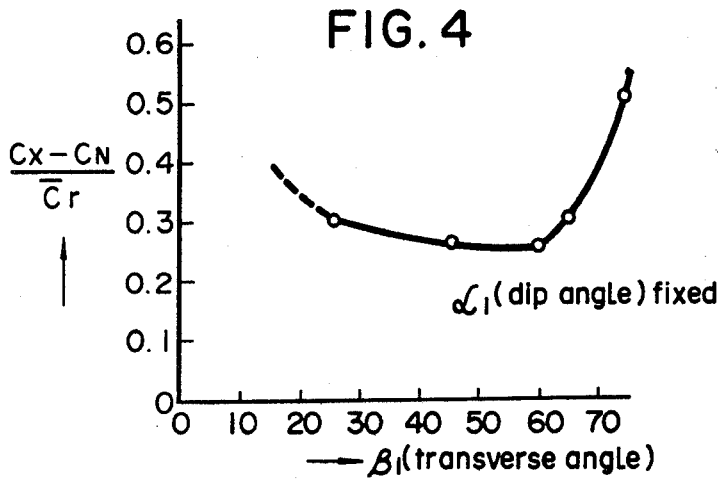
FIG. 4 is a graph showing the relationship between the transverse angle and the uniform cooling effect.

FIGS. 3 and 4 respectively show by way of example the effect of the dip angle $\alpha_1$ and the transverse angle $\beta_1$ on the uniformity of cooling rate in the circumferential direction of a steel pipe with the diameter of 24 inches which was cooled by a single header with the gap between the header and the pipe being 30 mm. Although additional experiments were also conducted on many other steels pipes of different diameters by using different gaps between the pipes and the header, the results obtained were substantially the same with those shown in FIGS. 3 and 4 excepting some parallel translations in the direction of the ordinate. In FIGS. 3 and 4, numerals $\overline{C}_r$, $C_X$ and $C_N$ show respectively average cooling rate in pipe circumferential direction, maximum cooling rate in pipe circumferential direction and minimum cooling rate in pipe circumferential direction. It will thus be seen from these results that the dip angle $\alpha_1$ of jets must be in the range between 15° and 45° and the transverse angle must be in the range of $0 < \beta_1 \leqq 65°$. In other words, if the dip angle $\alpha_1$ is less than 15°, in view of the previously mentioned flow velocity requirements, the points of contact at which the water jets from the first header 6 impinge onto the pipe do not lie on the circumference which cuts the pipe at right angles and thus the uniformity of circumferential cooling is deteriorated. On the other hand, if the dip angle $\alpha_1$ is greater than 45°, the water jets from the header 6 result in a back flow flowing in the direction of the heating unit 4 from the points of their impingement onto the pipe, with the result that a small amount of water from the back flow contacts with the hot pipe portion emerging from the heating unit 4 and it is turned into vapor by the Leidenfrost phenomenon thus pre-cooling only the upper surface of the pipe and thereby considerably deteriorating the uniformity of cooling. Next, considering the transverse angle $\beta_1$, in the case of the conventional method wherein the headers spray coolant with no transverse angle ($\beta_1 = 0$), the water jets, after impingement on the pipe, result in a water stream on the pipe which is parallel to the direction of travel of the pipe and moreover those portions of the pipe where the water jets do not impinge or where there is less contact with the cooling water are moved on as such without being contacted with the cooling water thus tending to give rise to non-uniformity of cooling. For these reasons, the transverse angle $\beta_1$ must be greater than 0°. On the other hand, if the value of $\beta_1$ is greater than 65°, the uniformity of cooling is quickly deteriorated as will be seen from FIG. 4 and moreover it is difficult to form in the header spray nozzles which provide a transverse angle $\beta_1$ which is greater than 65°. Thus, the transverse angle $\beta_1$ must be $0 < \beta_1 < 65°$ and it should more preferably be in the range between 25° and 65°. The first and second headers according to the invention respectively have predetermined transverse angles $\beta_1$ and $\beta_2$ and moreover the flow velocity of the jets from the headers is kept within the proper limits so that the water jets results in a laminar flow which circles around the outer wall of a pipe to be cooled and a plurality of streams strike the selected portions on the circumference of the pipe by virtue of a certain angle formed between the direction of travel of the pipe and the water jets, thus considerably reducing the non-uniformity of cooling. Since the cooling water sprayed from the second header it utilized for cooling the pipe which has been cooled considerably by the cooling water from the first header, the ranges of the dip and transverse angles of the water jets from the second header need not be so strictly defined as in the case of the first header. In short, it is only necessary that the second header sprays the cooling water at a velocity in the previously mentioned range so that the water jets result in a laminar flow along the pipe surface and strikes against the laminar flow of the water jets from the first header to thereby form a swell of the cooling water along the circumference of the pipe. Thus, the dip angle $\alpha_2$ of the water jets from the second header 7 which is shown in FIG. 2 may have any given value provided that the water jets, after impinging the pipe, result in a laminar flow directed toward the first header. Also the transverse angle $\beta_2$ may have any given value provided that the selected angle permits easy formation of the spray nozzles in the second header 7 from the standpoint of the working thereof.

That which is important all the more for the first and second headers in relation to each other is the feature (b), namely, the feature (b) indicates as an essential requirement that the distance between the circumferential line defined on the pipe surface by connecting the points of impingement onto the pipe surface of the water jets from the spray nozzles of the first header and the similar circumferential line by the water jets from the second header must be in the range between 50 and 250 mm. In other words, since the flow velocity of the water jets from the headers is in such a range that the water jets from each of the headers result in a laminar flow, if the distance between the two circumferential lines is greater than 250 mm, the energy of the laminar flow is reduced thus failing to form the required swell of the cooling water at the middle of the distance as required by the feature (d). On the other hand, if the distance is less than 50 mm, while the energy of the laminar flow flowing over the pipe surface from each side is large enough to form the required swell of the cooling water, the swell tends to become unstable both in form and position and moreover there is the danger of the cooling water forming the swell creeping between the water jets from the first header and cooling (pre-cooling) the pipe in advance of the points where the water jets from the first header impinge onto the pipe surface. Thus, the use of any distance smaller than 50 mm must be avoided.

By satisfying the above-mentioned three essential requirements regarding the velocity of water jets, the spray angle of jets and the length of laminar flows on the pipe surface, it is possible to cause the water jets from the first header to start cooling at the same time along the cross-section of the pipe thus reducing the non-uniformity of cooling as far as possible and moreover the formation of a swell of the cooling water on the pipe surface also has the effect of reducing the non-uniformity of cooling and ensuring effective utilization of all the sprayed cooling water as well.

A patent application, Ser. No. 652576 has already been filed on Jan. 26, 1976 U.S. Pat. No. 4,050,963 for a method which is similar in subject matter with the above-described method of this invention and in which in the process of cooling a steel pipe for quenching purposes, the deviation of the pipe from the desired roundness due to the non-uniformity of cooling is measured at each of a plurality of positions on the circumference of the pipe, whereby the amount of cooling water directed against the circumferential point corresponding to the associated detector is controlled in accordance with the detected deviation and the amount of correcting pressure at the circumferential position corresponding to the detector is also controlled. According to the present invention, a method has been developed in which to ensure uniform cooling, the dip and transverse angle of water jets from the headers, the distance between the circumferential lines defined by connecting the points of impingement onto the pipe surface of the water jets from the headers and the velocity of water jets are determined experimentally, thus eliminating the need for all of the measurement of roundness of the cooled pipe effected in the rear part of the zone and the control of the amount of cooling water and the amount of correcting pressure in accordance with the detected deviation from the roundness as will be seen from the results of the experiments which will be described later.

Figure 5:
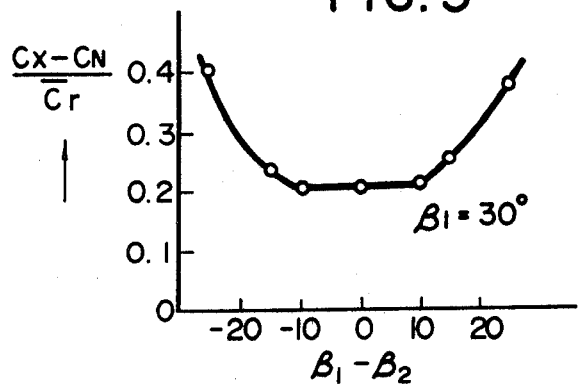
FIG. 5 is a graph showing the relationship between the transverse angles of the first and second headers and the uniform cooling effect.

FIG. 5 shows an example of the relationship between the non-uniformity of circumferential cooling and the transverse angle $\beta_1$ of the first header and the transverse angle $\beta_2$ of the second header in the case where the cooling was effected with the first and second headers. As will be seen from FIG. 2, the maximum uniformity of cooling can be ensured by selecting the transverse angles in such a manner that the water jets from the first header flow substantially in a direction opposite to that of the water jets from the second header, namely, the difference between the transverse angles is kept within $\pm 15°$. Thus, the transverse angle for the second header should preferably be selected to keep its deviation from that for the first header within $\pm 15°$ so as to ensure more uniform cooling.

Figure 6:
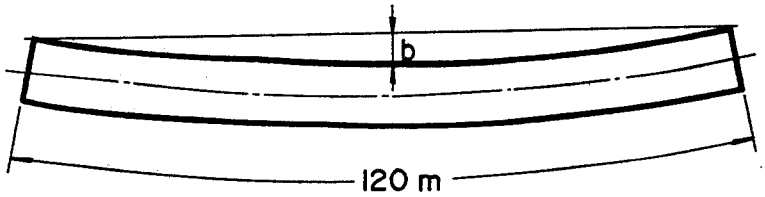
FIG. 6 is a schematic diagram useful for explaining the amount of bend in a pipe.
Figure 7:
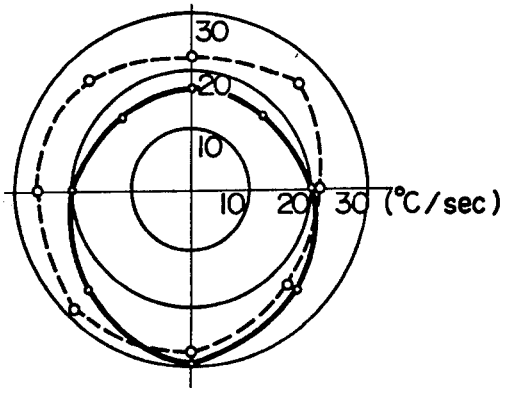
FIG. 7 is a diagram showing the distribution of cooling rates according to the test results on the pipe made by employing the method of this invention.

Steel pipes having 24 inch-diameter, 16 mm - wall thickness and 12 m - length were quenched by cooling the outer surface of the steel pipes from 900° C. with water according to the method of the present invention and the conventional method, respectively and the results obtained showed that the amount of the lengthwise bend b shown in FIG. 6 was 8.2 mm in the case of the present invention and that of the pipe cooled by the conventional method was 23.0 mm. According to the results of the measurement made by embedding a thermocouple in the central portion of the wall thickness of each of the steel pipes which were cooled with the cooling water flow rate of 2 $m^3/m^2$ min, i.e., the measurement results shown in FIG. 7, the results of the method of this invention shown by the dotted line in the Figure are apparently superior in both uniformity of cooling and cooling rate to those of the conventional method which were shown by the solid lines.

While the method of the present invention is capable of processing most of the metal pipes from 18 inches to 50 inches or more in diameter by arranging the above-described first and second headers, one or more additional headers may be arranged in the rear of the second header in case of need, particulary when processing larger diameter pipes or greater thickness pipes. Since such additional headers will be used for cooling the pipe which has been cooled considerably, there is no need to specifically limit the construction and position of these headers. Further, while, the method of this invention is designed for cooling the outer surface of metal pipes, the method of this invention may effectively be utilized for quenching purposes in combination with any other method designed for cooling the inner surface of metal pipes.

What is claimed is:

1. In the method of cooling a large diameter metal pipe whereby, in the quenching of said metal pipe, said pipe is rapidly cooled by spraying cooling jet water on the surface of said pipe from a large number of jet nozzles contained in each of a first and second ring header arranged to encircle said metal pipe, the improvement wherein:

(1) the water jets from the spray nozzles in said first header are directed in the same direction as the travel of the pipe at the following angles:

dip angle $\alpha_1$: $15° \leqq \alpha_1 \leqq 45°$
transverse angle $\beta_1$: $0° < \beta_1 \leqq 65°$ (2) the water jets from the jet nozzle in the second header are directed to the opposite direction of the travel of the pipe and are at the following angles:
dip angle $\alpha_2$: $15° \leqq \alpha_2 \leqq 45°$
transverse angle $\beta_2$: $0° < \beta_2 \leqq 65°$ (3) the distance between a circumferential line defined on said pipe by connecting the points of impingement on the surface of said metal pipe of the water jets sprayed in the direction of said second header from the jet nozzles in said first header and the smaller circumferential line provided by the water jets sprayed in the direction of said first header from the jet nozzles in said second header is in the range between 50 and 250 mm as measured in the lengthwise direction of said metal pipe;

(4) the velocity of said water jets is in the range between 0.5 and 7 m/sec.;

and (5) the water jets from the first and second headers are directed toward each other along the axial direction of the pipe and impinge on the surface of the pipe between said headers to provide a circular swell of cooling water therebetween which surrounds the pipe.

2. A method according to claim 1, wherein the difference between the transverse angle $\beta_1$ of the water jets from the jet nozzles in said first header and the similar transverse angle $\beta_2$ for said second header is kept within $\pm 15°$.

3. A method according to claim 1, wherein the transverse angle $\beta_1$ of the water jets from the jet nozzles in said first header is in the range of $25° \leqq \beta_1 \leqq 65°$.

* * * * *